US012644626B2

(12) United States Patent
Tzu

(10) Patent No.: US 12,644,626 B2
(45) Date of Patent: Jun. 2, 2026

(54) SAFETY CONTROL SYSTEM FOR ELECTRIC WATER HEATER

(71) Applicant: National Kaohsiung University of Science and Technology, Kaohsiung City (TW)

(72) Inventor: Fu-Ming Tzu, Kaohsiung City (TW)

(73) Assignee: NATIONAL KAOHSIUNG UNIVERSITY OF SCIENCE AND TECHNOLOGY, Kaohsiung City (TW)

( * ) Notice: Subject to any disclaimer, the term of this patent is extended or adjusted under 35 U.S.C. 154(b) by 421 days.

(21) Appl. No.: 18/378,853

(22) Filed: Oct. 11, 2023

(65) Prior Publication Data

US 2025/0067475 A1 Feb. 27, 2025

(30) Foreign Application Priority Data

Aug. 21, 2023 (TW) ..... 112131393

(51) Int. Cl.
*F24H 15/128* (2022.01)
*F24H 15/124* (2022.01)
(Continued)

(52) U.S. Cl.
CPC ..... *F24H 15/128* (2022.01); *F24H 15/124* (2022.01); *F24H 15/215* (2022.01); *F24H 15/219* (2022.01)

(58) Field of Classification Search
CPC .... F24H 15/124; F24H 15/128; F24H 15/215; F24H 15/219; F24H 19/1051; H05B 1/0283; H05B 2203/021
See application file for complete search history.

(56) References Cited

U.S. PATENT DOCUMENTS 4,638,147 A * 1/1987 Dytch ..... F24H 15/128 219/486
6,246,831 B1 * 6/2001 Seitz ..... F24H 15/174 219/483

(Continued)

FOREIGN PATENT DOCUMENTS

TW 1773582 B * 8/2022
WO WO-9319332 A1 * 9/1993 ..... F24H 1/103

OTHER PUBLICATIONS

Machine translation of TW-1773582-B; Retrieved from ESPACENET (Year: 2025).*

*Primary Examiner* — Sang K Kim
(74) *Attorney, Agent, or Firm* — WPAT, PC

(57) ABSTRACT

A safety control system for an electric water heater includes: an inner tank, having a first pipeline, the inner tank including a water inlet connected with a water inlet pipe and a water outlet connected to a water outlet pipe, the water inlet pipe connected to a cold water source and in communication with the first pipeline through the water inlet, and the water outlet pipe in communication with the first pipeline through the water outlet; a heating module, arranged in the first pipeline; a sensing module, configured to sense a temperature of a cold water source flowing through the first pipeline; and a control device, configured to: verify whether the temperature is consistent with a set water temperature, and control on/off and a heating temperature of the heating module until the temperature is consistent with the set water temperature if a result of the verification is no.

7 Claims, 2 Drawing Sheets

(51) Int. Cl.
*F24H 15/215* (2022.01)
*F24H 15/219* (2022.01)

(56) References Cited

U.S. PATENT DOCUMENTS

| | | | | |
|---|---|---|---|---|
| 8,787,742 | B2 * | 7/2014 | Lutz | F24H 15/215 392/449 |
| 9,939,172 | B2 * | 4/2018 | Qiu | F24H 1/107 |
| 12,209,774 | B2 * | 1/2025 | Rice | G06F 3/0219 |
| 12,276,441 | B2 * | 4/2025 | Bae | F24H 15/414 |
| 12,422,148 | B1 * | 9/2025 | Chandler, Jr. | F24H 15/281 |
| 2008/0006226 | A1 * | 1/2008 | Takeda | F24H 8/00 122/18.1 |
| 2012/0057857 | A1 * | 3/2012 | Kenney | H05B 1/0244 219/494 |
| 2024/0167727 | A1 * | 5/2024 | Cardoso | F24H 15/37 |

* cited by examiner

SAFETY CONTROL SYSTEM FOR ELECTRIC WATER HEATER

CROSS-REFERENCE TO RELATED APPLICATION

This application claims the benefit of Taiwan Patent Application No. 112131393, filed on 21 Aug. 2023, which is hereby incorporated by reference for all purposes as if fully set forth herein.

BACKGROUND

Technical Field

The present invention mainly relates to an electric water heater, and in particular, to a safety control system for an electric water heater that automatically adjusts a temperature of discharged water of an electric water heater based on a set water temperature.

Related Art

A conventional electric water heater is equipped with a safety switch having an earth leakage circuit breaker structure, which is configured to perform a protective function for a load side on which a heater and a temperature control switch of the conventional electric water heater are located by opening a circuit in case of current leakage. The temperature control switch is powered within an appropriate heating temperature in response to a wall temperature of the heater, and is powered off when overheating occurs, so that the heater stops and continues to heat to maintain a normal water temperature.

However, once an over-temperature power-off function of the temperature control switch fails, the heater is continuously heated or abnormal, which endangers safety of a user. Seriously, hot water or cold water generated by the heater may even flow out automatically and be sprayed on the user, causing a certain degree of injury and fright to the user. In addition, when the sudden cold water is splashed on the body, it is also easy to cause a sympathetic nerve of the user to be stimulated, resulting in a fast heartbeat and a high blood pressure, which increases incidence of a cardiovascular disease and a cerebrovascular disease, thereby affecting health of the user.

In view of this, a safety control system for an electric water heater is necessarily to be provided to solve the above problems.

SUMMARY

The present invention is intended to provide a safety control system for an electric water heater, which can automatically adjust a temperature of discharged water of an electric water heater based on a set water temperature.

In order to achieve the objective, the present invention provides a safety control system for an electric water heater. The system includes: an inner tank, having a first pipeline formed inside, where the inner tank comprises a water inlet connected to a water inlet pipe and a water outlet connected to a water outlet pipe, the water inlet pipe is connected to a cold water source and is in communication with the first pipeline through the water inlet, and the water outlet pipe is in communication with the first pipeline through the water outlet; a heating module, comprising a first heating element, a second heating element, and a third heating element arranged in the first pipeline in sequence, where the first heating element is closer to the water inlet; a sensing module, comprising a first sensing unit, a second sensing unit, a third sensing unit, and a fourth sensing unit, where the first sensing unit is arranged on the water inlet pipe and is configured to sense a first temperature, the second sensing unit is arranged on the first pipeline between the first heating element and the second heating element and is configured to sense a second temperature, the third sensing unit is arranged on the first pipeline between the second heating element and the third heating element and is configured to sense a third temperature, and the fourth sensing unit is arranged on the water outlet pipe and is configured to sense a fourth temperature; and a control device, comprising a microcontroller, where the microcontroller is electrically connected to the first heating element, the second heating element, the third heating element, the first sensing unit, the second sensing unit, the third sensing unit, and the fourth sensing unit, and is configured to: verify whether the second temperature is in a first temperature range, whether the third temperature is in a second temperature range, and whether the fourth temperature is consistent with a set water temperature, and control on/off and heating temperatures of the first heating element, the second heating element, and the third heating element until the fourth temperature is consistent with the set water temperature if a result of any of the verifications is no, where an upper limit value and a lower limit value of the second temperature range are respectively less than the set water temperature and greater than an upper limit value of the first temperature range.

In some embodiments, the microcontroller is configured to: determine whether the second temperature is in the first temperature range; and control the first heating element to stop operating and control the heating temperatures of the second heating element and the third heating element until the fourth temperature is consistent with the set water temperature if a result of the determination is no.

In some embodiments, the microcontroller is configured to: determine whether the second temperature is in the first temperature range; verify whether the third temperature is in the second temperature range if a result of the determination is yes; and control the second heating element to stop operating and control the heating temperature of the third heating element until the fourth temperature is consistent with the set water temperature if a result of the verification is no.

In some embodiments, a second pipeline independent of the first pipeline is further formed inside the inner tank, a first three-way valve and a second three-way valve are arranged inside the inner tank, a water inlet end of the first three-way valve is engaged with the water inlet, two water inlet ends of the second three-way valve are connected through pipes to two water outlet ends of the first three-way valve respectively to form the first pipeline and the second pipeline respectively, a water outlet end of the second three-way valve is engaged with the water outlet, and the microcontroller is configured to: determine whether the second temperature is in the first temperature range; verify whether the third temperature is in the second temperature range if a result of the determination is yes; compare whether the fourth temperature is greater than the set water temperature if a result of the verification is yes; and control a valve of the water outlet end of the first three-way valve relative to the second pipeline to be turned on until the fourth temperature is consistent with the set water temperature if a result of the comparison is yes.

In some embodiments, a second pipeline independent of the first pipeline is further formed inside the inner tank, a first three-way valve and a second three-way valve are arranged inside the inner tank, a water inlet end of the first three-way valve is engaged with the water inlet, two water inlet ends of the second three-way valve are connected through pipes to two water outlet ends of the first three-way valve respectively to form the first pipeline and the second pipeline respectively, a water outlet end of the second three-way valve is engaged with the water outlet, the heating module further comprises a fourth heating element arranged in the second pipeline, and the microcontroller is configured to: determine whether the second temperature is in the first temperature range; verify whether the third temperature is in the second temperature range if a result of the determination is yes; analyze whether the fourth temperature is less than the set water temperature if a result of the verification is yes; and control the third heating element to stop operating, control a valve of the water outlet end of the first three-way valve relative to the second pipeline to be turned on, and control the heating temperature of the fourth heating element until the fourth temperature is consistent with the set water temperature if a result of the analysis is yes.

In some embodiments, the sensing module further comprises a fifth sensing unit electrically connected to the microcontroller and configured to sense a temperature of cold water source dripping onto a user to obtain a fifth temperature, and the microcontroller is configured to: parse whether the fifth temperature is less than the fourth temperature; and replaces the fourth temperature sensed by the fourth sensing unit with the fifth temperature and determine whether the fifth temperature is consistent with the set water temperature if a result of the parsing is no.

In some embodiments, the control device further comprises a wireless transmission unit electrically connected to the microcontroller and a mobile device, and the microcontroller is configured to: determine the first heating element as a failed heating element when the second temperature is not in the first temperature range, determines the second heating element as a failed heating element when the third temperature is not in the second temperature range, determine the third heating element as a failed heating element when the fourth temperature is inconsistent with the set water temperature, and transmit the failed heating elements to the mobile device through the wireless transmission unit.

The safety control system for an electric water heater of the present invention has the following characteristics. The first heating element, the second heating element, and the third heating element are arranged to perform heating section by section. The second sensing unit senses a temperature of the cold water source flowing between the first heating element and the second heating element, the third sensing unit senses a temperature of the cold water source flowing between the second heating element and the third heating element, and the fourth sensing unit senses a temperature of the cold water source flowing through the water outlet pipe, to respectively obtain the second temperature, the third temperature, and the fourth temperature. The microcontroller determines whether the first heating element, the second heating element, or the third heating element fails by analyzing the second temperature, the third temperature, and the fourth temperature, and controls the heating temperature of the heating element that has not failed, so that the final cold water source temperature can still reach the set water temperature. In this way, the safety control system for an electric water heater of the present invention can achieve functions such as saving electricity costs and avoiding endangering health of a user.

DETAILED DESCRIPTION

Embodiments of the present invention are described in detail as follows with reference to the drawings. The accompanied drawings are simplified schematic diagrams, which are merely used for illustrating basic structures of the present invention. Therefore, only elements related to the present invention are indicated in these drawings. The elements that are shown are not drawn based on a quantity, a shape, a size ratio, and the like during implementation. Actual specifications and dimensions during the implementation are selectively designed, and a layout of the elements may be more complicated.

Descriptions of the following embodiments are provided with reference to the attached drawings to illustrate specific embodiments of the present invention that may be implemented accordingly. Direction terms such as "upper", "lower", "front", "back" and the like mentioned in the present invention are merely directions for reference to the attached drawings. Therefore, the direction terms that are used are used for describing and understanding this application, rather than limiting this application. In addition, in the specification, unless expressly described to the contrary, the word "include" is to be understood as including described elements without excluding any other elements.

Figure 1:
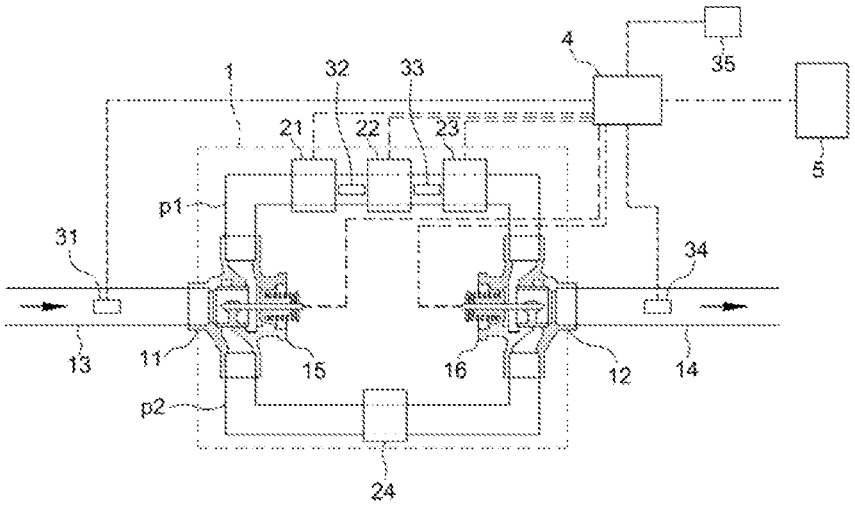
FIG. 1 is a configuration architecture diagram of a safety control system for an electric water heater according to the present invention.
Figure 2:
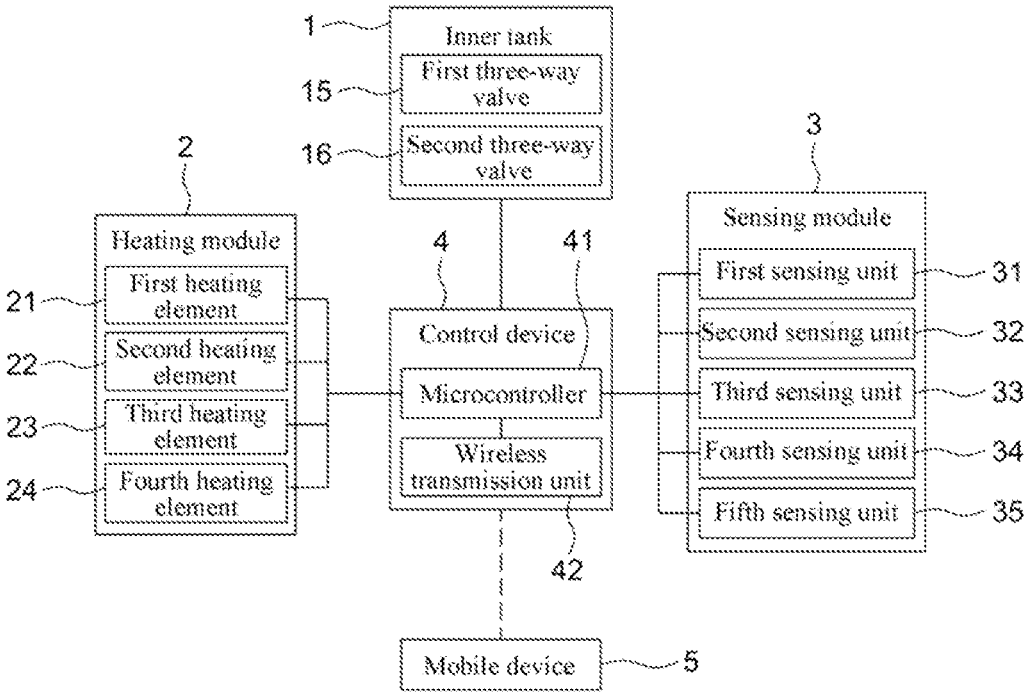
FIG. 2 is a system block diagram of a safety control system for an electric water heater according to the present invention.

FIG. 1 and FIG. 2 are respectively a configuration architecture diagram and a system block diagram of a safety control system for an electric water heater according to the present invention. The system includes an inner tank 1, a heating module 2, a sensing module 3, and a control device 4. The heating module 2 and the sensing module 3 are respectively arranged on the inner tank 1, and the control device 4 is electrically connected to the heating module 2 and the sensing module 3.

The inner tank 1 includes a water inlet 11, a water outlet 12, a water inlet pipe 13 connected to the water inlet 11, and a water outlet pipe 14 connected to the water outlet 12. The water inlet pipe 13 is connected to a cold water source. A first three-way valve 15 and a second three-way valve 16 are arranged inside the inner tank 1. A water inlet end of the first three-way valve 15 is engaged with the water inlet 11. Two water inlet ends of the second three-way valve 16 are connected through pipes to two water outlet ends of the first three-way valve 15 respectively to form the first pipeline p1 and the second pipeline p2 respectively. The first pipeline p1 and the second pipeline p2 are independent of each other, and a water outlet end of the second three-way valve 16 is engaged with the water outlet 12. In this embodiment, the first three-way valve 15 and the second three-way valve 16 are both proportional electric three-way valves.

The heating module 2 includes a first heating element 21, a second heating element 22, and a third heating element 23 arranged in the first pipeline p1 in sequence. The first heating element 21 is closer to the water inlet 11, and the third heating element 23 is closer to the water outlet 12. In this embodiment, the first heating element 21, the second heating element 22, and the third heating element 23 are all electric heating elements.

The sensing module 3 includes a first sensing unit 31, a second sensing unit 32, a third sensing unit 33, and a fourth sensing unit 34, where the first sensing unit 31 is arranged on the water inlet pipe 13 and is configured to sense a first temperature. The second sensing unit 32 is arranged in a first pipeline p1 between the first heating element 21 and the second heating element 22 and is configured to sense a second temperature. The third sensing unit 33 is arranged in a first pipeline p1 between the second heating element 22 and the third heating element 23 and is configured to sense a third temperature. The fourth sensing unit 34 is arranged on the water outlet pipe 14 and is configured to sense a fourth temperature. In this embodiment, the first sensing unit 31, the second sensing unit 32, the third sensing unit 33, and the fourth sensing unit 34 are all digital temperature sensors.

The control device 4 includes a microcontroller 41. The microcontroller is electrically connected to the first heating element 21, the second heating element 22, the third heating element 23, the first sensing unit 31, the second sensing unit 32, the third sensing unit 33, and the fourth sensing unit 34. In this embodiment, the microcontroller 41 is also referred to as a single-chip microcomputer.

The microcontroller 41 is configured to: verify whether the second temperature is in a first temperature range, whether the third temperature is in a second temperature range, and whether the fourth temperature is consistent with a set water temperature, and control on/off and heating temperatures of the first heating element 21, the second heating element 22, and the third heating element 23 until the fourth temperature is consistent with the set water temperature if a result of any of the verifications is no, where an upper limit value and a lower limit value of the second temperature range are respectively less than the set water temperature and greater than an upper limit value of the first temperature range.

It should be noted that, in the present invention, the first heating element 21, the second heating element 22, and the third heating element 23 are arranged to perform heating section by section, so that the temperature of the cold water source can be heated to the set water temperature section by section, which has an effect of saving electricity costs. For example, when the temperature of the cold water source is 30° C. and the set water temperature is 60° C., the first heating element 21 can first increase the temperature of the cold water source to a range of 31° C. to 40° C., preferably directly to 40° C. Subsequently, the second heating element 22 increases the temperature of the cold water source to a range of 41° C. and 50° C., preferably directly to 50° C. Finally, the third heating element 23 increases the temperature of the cold water source to 60° C., which is not limited thereto.

Figure 3:
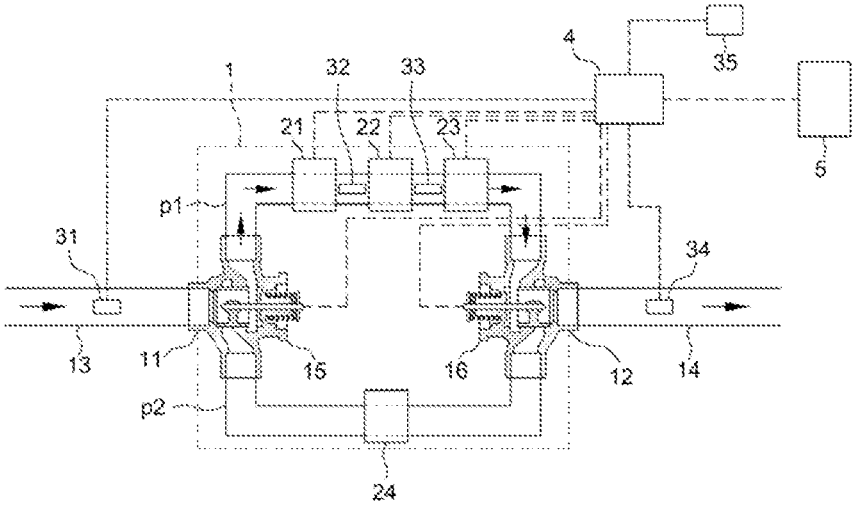
FIG. 3 is a use state diagram of a safety control system for an electric water heater according to the present invention.

Referring to FIG. 3, in this embodiment, the cold water source flows to the water outlet pipe 14 through the first pipeline p1. That is to say, the first three-way valve 15 is in a closed state relative to a valve at a water outlet end of the second pipeline p2. The microcontroller 41 is configured to: determine whether the second temperature is in the first temperature range; and control the first heating element 21 to stop operating and control the heating temperatures of the second heating element 22 and the third heating element 23 until the fourth temperature is consistent with the set water temperature if a result of the determination is no.

On the other hand, the microcontroller 41 is configured to: determine whether the second temperature is in the first temperature range; verify whether the third temperature is in the second temperature range if a result of the determination is yes; and control the second heating element 22 to stop operating and control the heating temperature of the third heating element 23 until the fourth temperature is consistent with the set water temperature if a result of the verification is no.

Figure 4:
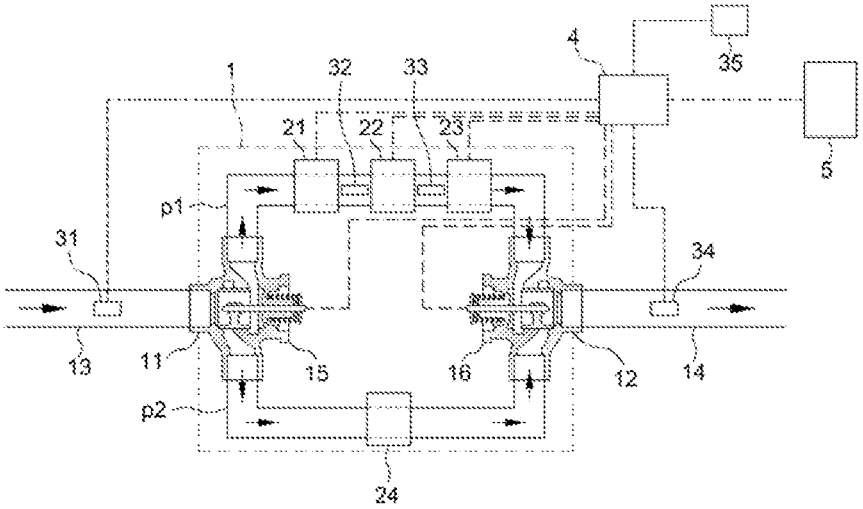
FIG. 4 is another use state diagram of a safety control system for an electric water heater according to the present invention.

Referring to FIG. 4, the microcontroller 41 is configured to: determine whether the second temperature is in the first temperature range; verify whether the third temperature is in the second temperature range if a result of the determination is yes; compare whether the fourth temperature is greater than the set water temperature if a result of the verification is yes; control a valve of the water outlet end of the first three-way valve 15 relative to the second pipeline p2 to be turned on to cause a part of the cold water source to flow to the water outlet pipe 14 through the second pipeline p2 until the fourth temperature is consistent with the set water temperature if a result of the comparison is yes; and skip performing an extra operation if a result of the comparison is no.

Referring to FIG. 4, in another embodiment, the heating module 2 further includes a fourth heating element 24 arranged in the second pipeline p2. In this embodiment, the fourth heating element 24 is also an electric heating element. The microcontroller 41 is configured to: determine whether the second temperature is in the first temperature range; verify whether the third temperature is in the second temperature range if a result of the determination is yes; analyze whether the fourth temperature is less than the set water temperature if a result of the verification is yes; control the third heating element 23 to stop operating, and control a valve of the water outlet end of the first three-way valve 15 relative to the second pipeline p2 to be turned on to cause a part of the cold water source to flow to the water outlet pipe 14 through the second pipeline p2 if a result of the analysis is yes; control the heating temperature of the fourth heating element 24 until the fourth temperature is consistent with the set water temperature; and skip performing an extra operation if a result of the analysis is no.

In another embodiment, the sensing module 3 further includes a fifth sensing unit 35 electrically connected to the microcontroller 41 and configured to sense a temperature of cold water source dripping onto a user to obtain a fifth temperature. In this embodiment, the fifth sensing unit 35 is a laser temperature measuring gun that uses non-contact laser induction technology. It should be understood that the temperature of the cold water source dripping onto the user is less than the set water temperature of the cold water source. Therefore, when the fifth temperature is greater than the fourth temperature, it means that a problem with the fourth temperature measured by the fourth sensing unit 34 exists. As a result, the microcontroller 41 is configured to: parse whether the fifth temperature is less than the fourth temperature; skip performing an extra operation if a result of the parsing is no, and replace the fourth temperature sensed by the fourth sensing unit 34 with the fifth temperature and determine whether the fifth temperature is consistent with the set water temperature if a result of the parsing is no.

In another embodiment, the control device 4 also includes a wireless transmission unit 42 electrically connected to the microcontroller 41 and a mobile device 5. In this embodiment, the wireless transmission unit 42 is a Bluetooth transmission module, and the mobile device 5 is a smart phone.

Specifically, the microcontroller 41 determines the first heating element 21 as a failed heating element when the second temperature is not in the first temperature range. The microcontroller 41 determines the second heating element 22 as a failed heating element when the third temperature is not in the second temperature range. The microcontroller 41 determines the third heating element 23 as a failed heating element when the fourth temperature is inconsistent with the set water temperature. The microcontroller 41 transmits the failed heating elements to the mobile device 5 through the wireless transmission unit 42, to remind the user that the first heating element 21, the second heating element 22, or the third heating element 23 are damaged.

Based on the above, in the safety control system for an electric water heater of the present invention, the first heating element, the second heating element, and the third heating element are arranged to perform heating section by section. The second sensing unit senses a temperature of the cold water source flowing between the first heating element and the second heating element, the third sensing unit senses a temperature of the cold water source flowing between the second heating element and the third heating element, and the fourth sensing unit senses a temperature of the cold water source flowing through the water outlet pipe, to respectively obtain the second temperature, the third temperature, and the fourth temperature. The microcontroller determines whether the first heating element, the second heating element, or the third heating element fails by analyzing the second temperature, the third temperature, and the fourth temperature, and controls the heating temperature of the heating element that has not failed, so that the final cold water source temperature can still reach the set water temperature. In this way, the safety control system for an electric water heater of the present invention can achieve functions such as saving electricity costs and avoiding endangering health of a user.

The embodiments disclosed above are only indicative of the principle, characteristics, and efficacy of the present invention, and are not intended to limit the scope of implementation of the present invention. Any person skilled in the art can modify and change the above embodiments without departing from the spirit and scope of the present invention. Any equivalent changes and modifications made using the disclosed content of the present invention shall still be covered by the scope of the patent application as follows.

What is claimed is:

1. A safety control system for an electric water heater, comprising:

an inner tank, having a first pipeline formed inside, wherein the inner tank comprises a water inlet connected to a water inlet pipe and a water outlet connected to a water outlet pipe, the water inlet pipe is connected to a cold water source and is in communication with the first pipeline through the water inlet, and the water outlet pipe is in communication with the first pipeline through the water outlet;

a heating module, comprising a first heating element, a second heating element, and a third heating element arranged in the first pipeline in sequence, wherein the first heating element is closer to the water inlet;

a sensing module, comprising a first sensing unit, a second sensing unit, a third sensing unit, and a fourth sensing unit, wherein the first sensing unit is arranged on the water inlet pipe and is configured to sense a first temperature, the second sensing unit is arranged on the first pipeline between the first heating element and the second heating element and is configured to sense a second temperature, the third sensing unit is arranged on the first pipeline between the second heating element and the third heating element and is configured to sense a third temperature, and the fourth sensing unit is arranged on the water outlet pipe and is configured to sense a fourth temperature; and a control device, comprising a microcontroller, wherein the microcontroller is electrically connected to the first heating element, the second heating element, the third heating element, the first sensing unit, the second sensing unit, the third sensing unit, and the fourth sensing unit, and is configured to: verify whether the second temperature is in a first temperature range, whether the third temperature is in a second temperature range, and whether the fourth temperature is consistent with a set water temperature, and control on/off and heating temperatures of the first heating element, the second heating element, and the third heating element until the fourth temperature is consistent with the set water temperature if a result of any of the verifications is no, wherein an upper limit value and a lower limit value of the second temperature range are respectively less than the set water temperature and greater than an upper limit value of the first temperature range.

2. The safety control system for an electric water heater according to claim 1, wherein the microcontroller is configured to: determine whether the second temperature is in the first temperature range; and control the first heating element to stop operating and control the heating temperatures of the second heating element and the third heating element until the fourth temperature is consistent with the set water temperature if a result of the determination is no.

3. The safety control system for an electric water heater according to claim 1, wherein the microcontroller is configured to: determine whether the second temperature is in the first temperature range; verify whether the third temperature is in the second temperature range if a result of the determination is yes; and control the second heating element to stop operating and control the heating temperature of the third heating element until the fourth temperature is consistent with the set water temperature if a result of the verification is no.

4. The safety control system for an electric water heater according to claim 1, wherein a second pipeline independent of the first pipeline is further formed inside the inner tank, a first three-way valve and a second three-way valve are arranged inside the inner tank, a water inlet end of the first three-way valve is engaged with the water inlet, two water inlet ends of the second three-way valve are connected through pipes to two water outlet ends of the first three-way valve respectively to form the first pipeline and the second pipeline respectively, a water outlet end of the second three-way valve is engaged with the water outlet, and the microcontroller is configured to: determine whether the second temperature is in the first temperature range; verify whether the third temperature is in the second temperature range if a result of the determination is yes; compare whether the fourth temperature is greater than the set water temperature if a result of the verification is yes; and control a valve of the water outlet end of the first three-way valve relative to the second pipeline to be turned on until the fourth temperature is consistent with the set water temperature if a result of the comparison is yes.

5. The safety control system for an electric water heater according to claim 1, wherein a second pipeline independent of the first pipeline is further formed inside the inner tank, a first three-way valve and a second three-way valve are arranged inside the inner tank, a water inlet end of the first three-way valve is engaged with the water inlet, two water inlet ends of the second three-way valve are connected through pipes to two water outlet ends of the first three-way valve respectively to form the first pipeline and the second pipeline respectively, a water outlet end of the second three-way valve is engaged with the water outlet, the heating module further comprises a fourth heating element arranged in the second pipeline, and the microcontroller is configured to: determine whether the second temperature is in the first temperature range; verify whether the third temperature is in the second temperature range if a result of the determination is yes; analyze whether the fourth temperature is less than the set water temperature if a result of the verification is yes; and control the third heating element to stop operating, control a valve of the water outlet end of the first three-way valve relative to the second pipeline to be turned on, and control the heating temperature of the fourth heating element until the fourth temperature is consistent with the set water temperature if a result of the analysis is yes.

6. The safety control system for an electric water heater according to claim 1, wherein the sensing module further comprises a fifth sensing unit electrically connected to the microcontroller and configured to sense a temperature of cold water source dripping onto a user to obtain a fifth temperature, and the microcontroller is configured to: parse whether the fifth temperature is less than the fourth temperature; and replace the fourth temperature sensed by the fourth sensing unit with the fifth temperature and determine whether the fifth temperature is consistent with the set water temperature if a result of the parsing is no.

7. The safety control system for an electric water heater according to claim 1, wherein the control device further comprises a wireless transmission unit electrically connected to the microcontroller and a mobile device, and the microcontroller is configured to: determine the first heating element as a failed heating element when the second temperature is not in the first temperature range, determine the second heating element as a failed heating element when the third temperature is not in the second temperature range, determine the third heating element as a failed heating element when the fourth temperature is inconsistent with the set water temperature, and transmit the failed heating elements to the mobile device through the wireless transmission unit.

* * * * *